United States Patent [19]

Frusta et al.

[11] Patent Number: 4,505,667

[45] Date of Patent: Mar. 19, 1985

[54] DEVICE WHICH CAN BE USED FOR THE COMBUSTION OF CORROSIVE PRODUCTS AND PROCESS USING THIS DEVICE

[75] Inventors: Georges Frusta, Digne; Francois Prudhon, Versailles, both of France

[73] Assignee: Atochem, Paris, France

[21] Appl. No.: 392,682

[22] Filed: Jun. 28, 1982

[30] Foreign Application Priority Data

Jul. 3, 1981 [FR] France ..... 81 13081

[51] Int. Cl.[3] ..... F23M 9/00

[52] U.S. Cl. ..... 431/182; 431/174; 431/284; 431/351; 239/400; 239/406

[58] Field of Search ..... 431/9, 10, 174, 182–184, 431/187, 188, 284, 351; 110/238; 239/400, 405, 406

[56] References Cited

U.S. PATENT DOCUMENTS

| | | | |
|---|---|---|---|
| 2,335,188 | 11/1943 | Kennedy | 431/284 |
| 2,806,517 | 9/1957 | Te Nuyl | 431/183 |
| 2,823,628 | 2/1958 | Poole et al. | 431/284 |

FOREIGN PATENT DOCUMENTS

| | | |
|---|---|---|
| 1438057 | 6/1976 | United Kingdom . |
| 2053452 | 2/1981 | United Kingdom . |

*Primary Examiner*—Carroll B. Dority, Jr.

*Attorney, Agent, or Firm*—McDougall, Hersh & Scott

[57] ABSTRACT

The invention relates to a method and device for the combustion of corrosive products, such as chlorine containing residues, comprising a combustion chamber, a dispersing head having an axial inlet for the phase to be burnt, and means for introducing two separate fractions of the combustive phase, and a plate for connecting the dispersing head to the combustion chamber.

3 Claims, 7 Drawing Figures

DEVICE WHICH CAN BE USED FOR THE COMBUSTION OF CORROSIVE PRODUCTS AND PROCESS USING THIS DEVICE

The present invention relates to a device which can be used, in particular, for the combustion of corrosive residues, such as those containing halogenohydrocarbons, in particular chlorohydrocarbons. It also relates to the combustion process using the said device.

The industrial manufacture of organic chlorine compounds generates vast amounts of residues frequently containing chlorine. These residues can be either in the the form of a gas, such as, for example, in the case of the manufacture of vinyl chloride or its polymers or copolymers, or in the form of a liquid and/or tarry solids obtained in the manufacture of aliphatic, cycloaliphatic and/or aromatic chlorohydrocarbons. The composition of these chlorine-containing residues varies according to their origin. Some residues comprise tarry chlorine-containing products in which at least some of the constituents contain more than 7 carbon atoms per molecule. Other chlorine-containing residues comprise $C_4$ chlorine compounds and/or $C_6$ chlorine compounds. These chlorine-containing residues can be accompanied by other compounds comprising $C_1$ to $C_4$ chlorine-containing constituents.

One method of solving the problem of the accumulation of these residues and the pollution of the air and/or water into which they can be discharged is to burn them at high temperatures, for example at between 900° and 1,450° C., in a combustion chamber, with the recovery of hydrogen chloride, which can be converted to an aqueous hydrochloric acid solution, and, if appropriate, the production of steam.

The burning of these residues is accompanied by rapid combustion, which can only be obtained in a stabile and continuous manner in specially adapted equipment. In fact, the combustion of this type of residue is accompanied by various difficulties and problems, namely blocking of the burners and the injectors, particularly if the residues are viscous, and difficult adjustments for obtaining total combustion to give hydrogen chloride containing only a minimum amount of free chlorine, together with a zero production of carbon, corrosion, and rapid deterioration of the parts of a burner if certain components or walls of the equipment are not protected by a refractory and/or acid-resistant coating or by means of special devices, for example devices for injecting a large volume of cold noncombustible gas around the flame. In addition, there may be mentioned the difficulties associated with sealing-up of the device in very large equipment, for example equipment capable of treating a 3 t/hour of residues, in particular because of the very large amounts of residues to be treated.

British patent application No. 2,053,452 proposes the use of a vortical airflow, the essential purpose of which is to stabilize the flame and to shape the said fleme, the dispersion of the phase to be burnt being itself achieved by means of an atomizing airflow, the phase to be burnt and the atomizing air being introduced in co-current flow and substantially along the axis of revolution (or of repetition or symmetry) of the flame.

British Pat. No. 1,438,057 describes a process for bringing into contact substances present in different phases, in which a symmetrical hollow-vortex flow is used in order to effect both the dispersion of the substance to be treated and the treatment of the said substance.

The process according to the said patent could be applied successfully to numerous applications. However, in the case of the burning of residues, there arise certain particular problems mentioned above. It is necessary, in particular, to succeed in maintaining a stable flame in a combustion chamber without damaging the said chamber, particularly the bottom of the chamber.

The present invention relates to a device which can be used, in particular, for the combustion of products or mixtures of products which are corrosive or capable of generating corrosive products, by bringing the said products, in the dispersed form, into contact with a combustive fluid at a temperature permitting the incandescence of the cloud of particles formed, the said device comprising a combustion chamber (7), a head (1) for dispersing the phase to be burnt in the said chamber, and a plate (2) for connecting the said dispersing head to the combustion chamber, and the said device being characterized in that the dispersing head comprises (A) means (12) for the axial introduction of the phase to be burnt, and means (15), (16), (17) for introducing a primary fraction of the combustive phase into the combustion chamber in the form of a hollow-vortex flow, to which a sufficient quantity of motion is imparted to cause the dispersion of the phase to be burnt, by transfer of the quantity of motion, and (B) means (21) for introducing a secondary fraction of the combustive phase into the combustion chamber, and means (24) for deflecting the said secondary fraction towards the base of the combustion zone, the dimensions and arrangement of the means B being such as to enable the secondary combustive fractions to form the complement of the combustive phase required for the combustion, and to ensure both the stabilization of the incandescent cloud and the cooling of the deflecting means mentioned under B and of the connecting plate.

According to a preferred embodiment of the invention, the dispersing head of the device comprises (a) a chamber for causing the rotation of the primary fraction of the combustive phase, said chamber comprising a tangential inlet (15) leading the combustive phase into an annular space between an outer envelope (16) and an inner envelope (17) perforated in its upstream part and behaving like a multitude of tangential inlets, (b) a device (8) for introducing the fluid containing the products to be burnt, the dimensions and arrangement of the zone where the combustive phase leaves the rotation chamber (a), and of the device (b), being such as to form a restricted annular passage (reference numbers 26 and 27), and (c) a device (24) for deflecting the secondary fraction of the combustive phase towards the base of the combustion zone, the said device delimiting a passage (28) around the combustion zone.

In the construction of the device according to the invention, it is recommended to make the dimensions of the various parts in question such that the ratio of the external diameter (27) to the internal diameter (26) of the restricted annular passage is between 1.1 and 1.6 and preferably between 1.15 and 1.4, and so that the ratio of the diameter (28) of the passage left by the deflecting device to the external diameter (27) is between 1.5 and 5, and preferably between 2 and 4.5.

The skilled in the art can select the precise ratios, within the limits recommended above, in particular as a function of the flow-rates chosen for the different phases and of the nature of the said fuel phase and combustive phase. Flow-rate values will be specified below.

The invention also relates to a process for burning various products, and more particularly products which are corrosive or capable of generating corrosive products, the said process being characterized in that it is carried out with the aid of the device described herein.

More precisely, the invention relates to a process in which the phase containing the products to be burnt is introduced, in the form of a fluid, along the axis of the hollow vortex formed by the primary fraction of the combustive phase, essentially as far as the reduced-pressure zone of the said hollow vortex, the quantity of motion imparted to the hollow vortex being sufficient to cause the dispersion into particles, of the phase to be burnt, by transfer of the quantity of motion. The secondary fraction of the combustive phase is introduced separately at a flow-rate and in a direction or directions which make it possible simultaneously to form the complement of the combustive phase required for the combustion and to ensure the cooling of that part of the device which surrounds the combustion zone and, in particular, of the plate for deflecting the secondary fraction towards the base of the combustion zone, and the stabilization of the incandescent cloud.

Preferably, the products to be burnt are introduced in the form of a gas and/or a liquid and/or a powder of small particle size, at a speed of the order of 1 to 10 m/second. The speed of the primary fraction of the combustive phase can preferably range from 100 to 400 m/second. In fact, the relationship between the primary combustive phase and the phase to be burnt is preferably expressed in terms of transfer of the quantity of motion. Generally, the ratio of the quantity of motion of this primary phase, at the level of the hollow vortex, to the quantity of motion of the phase to be burnt is at least 100 and is preferably between 500 and 10,000.

In carrying out the process according to the invention, the combustion zone is at a reduced pressure of the order of 10 to 1,500 Pa below atmospheric pressure, the pressure of the primary fraction being 0.2 to $0.8.10^5$ Pa and preferably 0.4 to $0.6.10^5$ Pa above the pressure measured in the combustion zone.

The secondary fraction of the combustive phase can be introduced into the combustion chamber by suction, by virtue of the reduced pressure prevailing in the said chamber. This suction can obviously be assisted by using means which make it possible to introduce the combustive phase under pressure. This secondary fraction can be introduced in the form of a single flow deflected towards the combustion zone by means of the abovementioned deflecting plate, or in the form of separate flows circulating on either side of the said deflecting plate.

The ratio of the flow-rate of the secondary fraction to the flow-rate of the primary fraction is advantageously between 0.1 to 10.

In accordance with a variant of the process and, in particular as a function of the nature of the products to be burnt, it is possible to supply a supplementary fuel in the form of a fluid. It is advantageous to use the vertical flow in order to ensure the dispersion of this fluid. For this purpose, it suffices to introduce this fluid into the device coaxially with the products to be burnt. This supplementary fuel can consist, for example, of propane gas.

According to another variant, a tertiary supplementary combustive phase can be supplied by coaxial introduction. The essential purpose of this supplementary phase is to modify the configuration of the cloud of particles. In general, this supplementary combustive material can be introduced under a pressure of between 10 and $10^5$ Pa.

In general, the combustive material consists of atmospheric oxygen, and the above indications, relating to the different fractions of the combustive phase, are based on combustion by air. It is self-evident that one or other or all of the fractions of the combustive phase could consist of oxygen or an oxygen-containing gas such as air, or, more generally, of a combustive fluid other than air.

For purposes of illustration, but not of limitation, an embodiment of the invention is shown in the accompanying drawings, in which:

FIG. 1 shows the essential elements of the device according to the invention.

Figure 1:
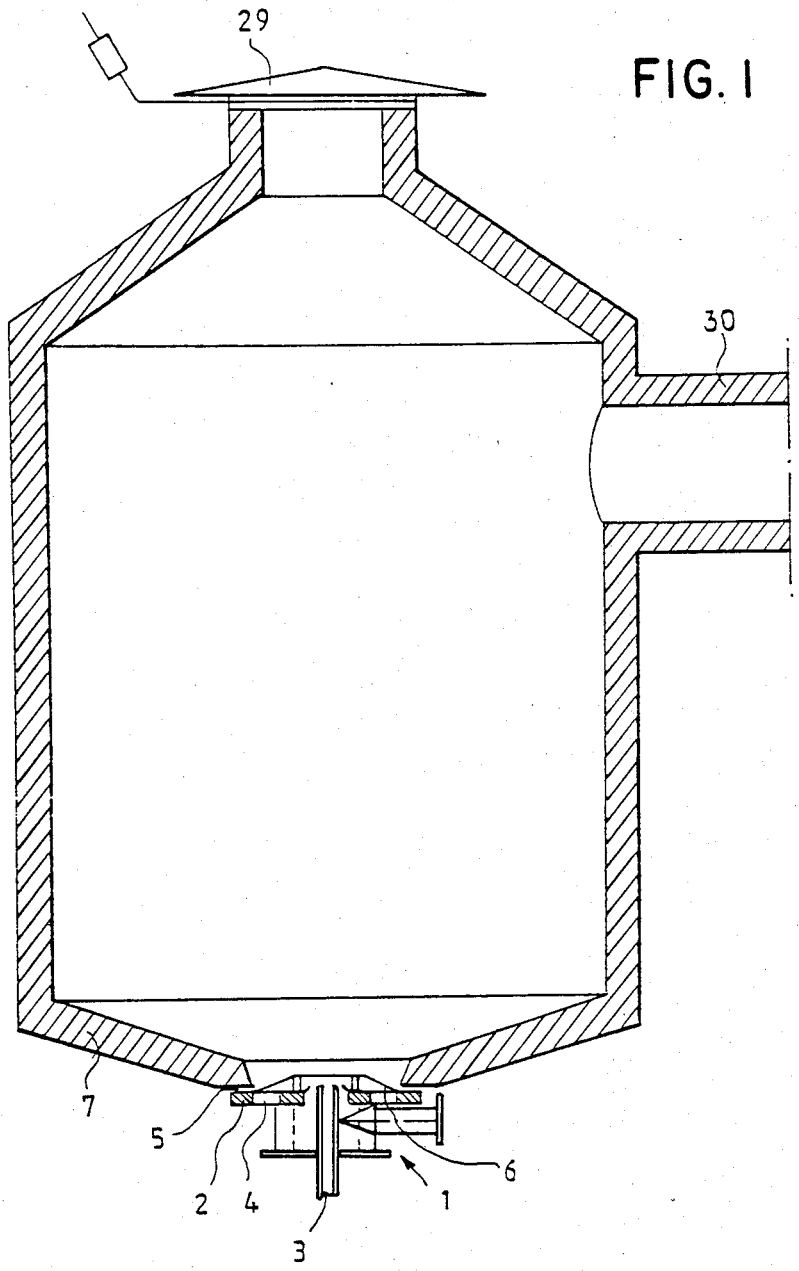
FIG. 1 is a schematic sectional elevational view of the device embodying the features of this invention.

This device comprises the dispersing head (1) at the bottom of the chamber, the support plate or connecting plate (2), the combustion chamber (7), the various inlets (3), (4), (5) for introduction of the fluids into the chamber, and the means (6) for deflecting a fraction of the combustive phase. This figure also shows the outlet passage (30) from the upper side wall of the chamber for the gases and an explosion seal (29) at the top of the chamber.

Figure 2:
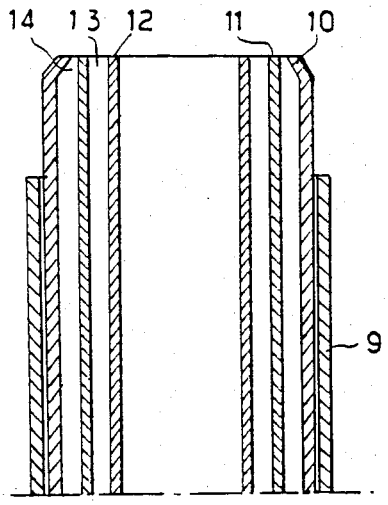
FIG. 2 is a sectional elevational view showing in detail the device for the axial introduction of the phase to be burnt and of the additional phases, if any.

FIG. 2 shows the axial inlet (3) in detail. It comprises:

a guide (9) and a tube (12) for introducing the fluid containing the products to be burnt.

This figure also shows the additional coaxial inlets, namely the tubes (10), (11) and (12), which make it possible, by means of the annular spaces (13) and (14), to introduce the supplementary fuels and/or combustive materials. Modification of the geometry of the tube (10) makes it possible also to modify the configuration of the combustion cloud and to perform an adjustment function.

Figure 3:
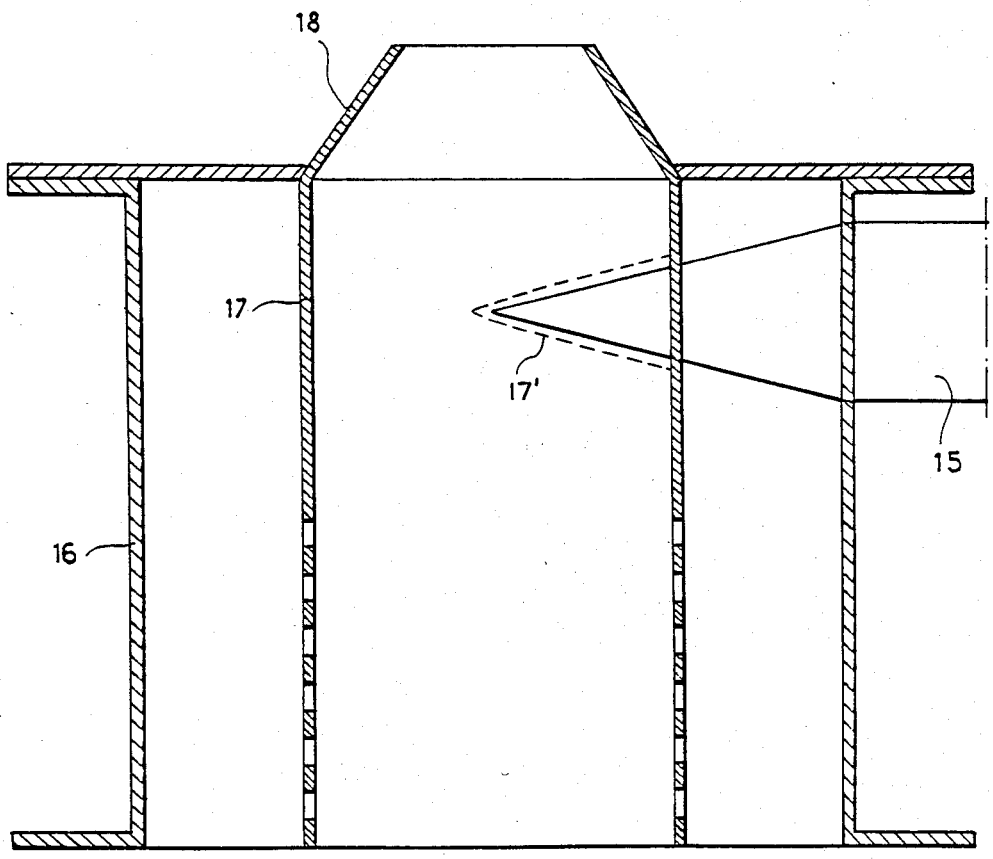
FIG. 3 is a sectional elevational view showing in detail the device generating the hollow vortex.

FIG. 3 illustrates more particularly the formation of the hollow-vortex flow by virtue of a tangential inlet (15), which leads the combustive phase into an annular space between the outer envelope (16) and the inner envelope (17); this envelope (17) is perforated in its upstream part as at 17', which enables it to behave like a multitude of tangential inlets. It is extended by a nozzle (18) in this FIG. 3. This arrangement makes it possible to ensure the symmetry of the vortical flow in a simple manner.

Figure 4:
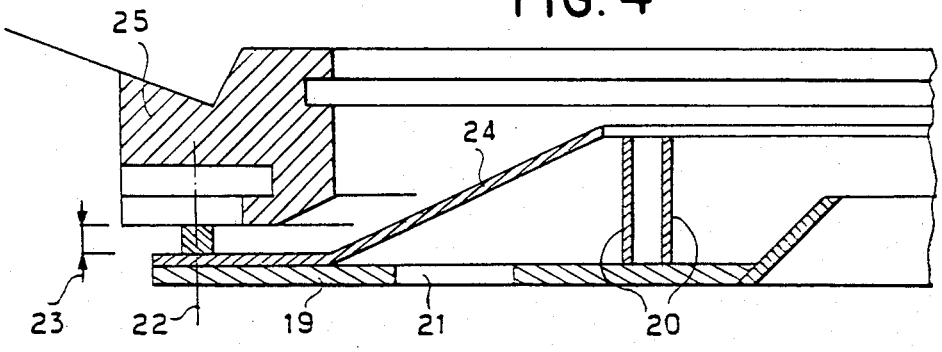
FIGS. 4 and 5 are sectional view showing two variants of the plate for connecting the dispersing head to the combustion chamber.

According to the embodiment illustrated in FIG. 4, the connecting plate (19) carries sleeves (20) and a deflector (24). It possesses inlet orifices (21) for a secondary fraction of the combustive phase, and fixing means (22) which can be adjusted, during operation, relative to the base (25) of the combustion chamber. Between the base (25) and the plate (19), there is an annular escape space (23) which permits the introduction of a second part of the secondary fraction of the combustive phase.

Figure 5:
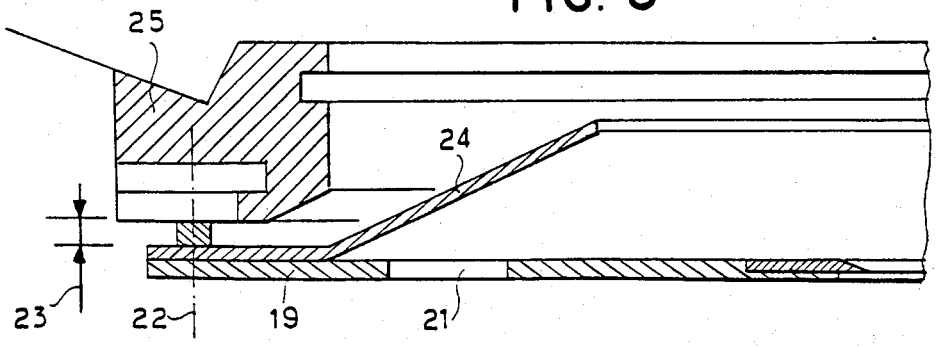

The device according to FIG. 5 corresponds to an assembly in which the cone (18) and the sleeves (20) have been omitted. On the other hand, a diaphragm has been arranged on the plate at the end of the perforated basket (17).

Figure 6:
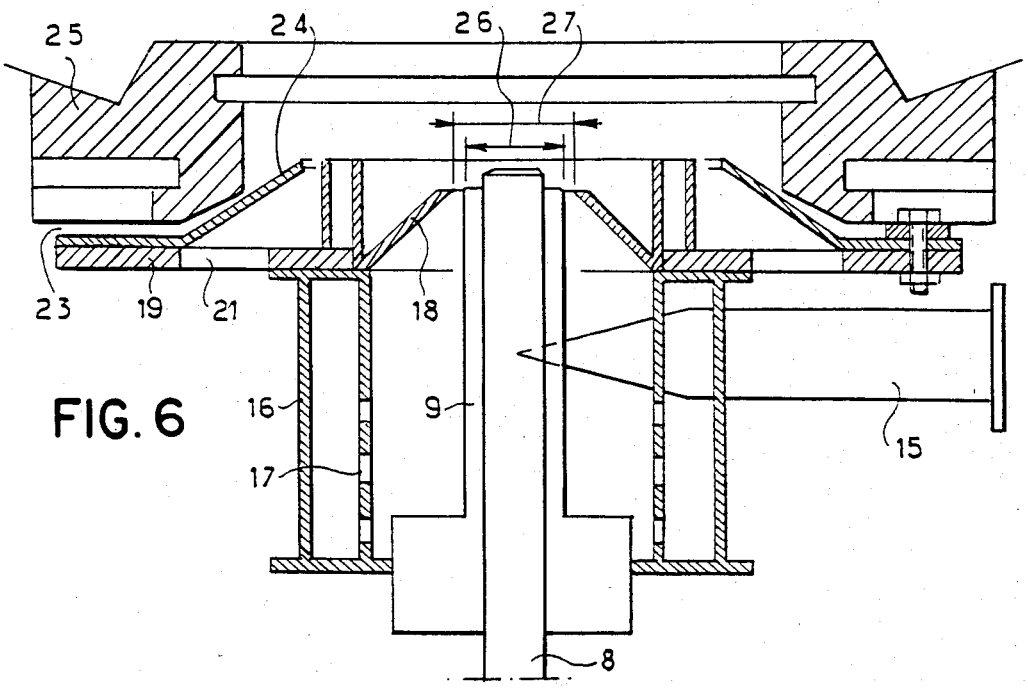
FIGS. 6 and 7 are sectional views showing two variants of the assembly comprising the dispersing head, the connecting plate and the base of the combustion chamber.
Figure 7:
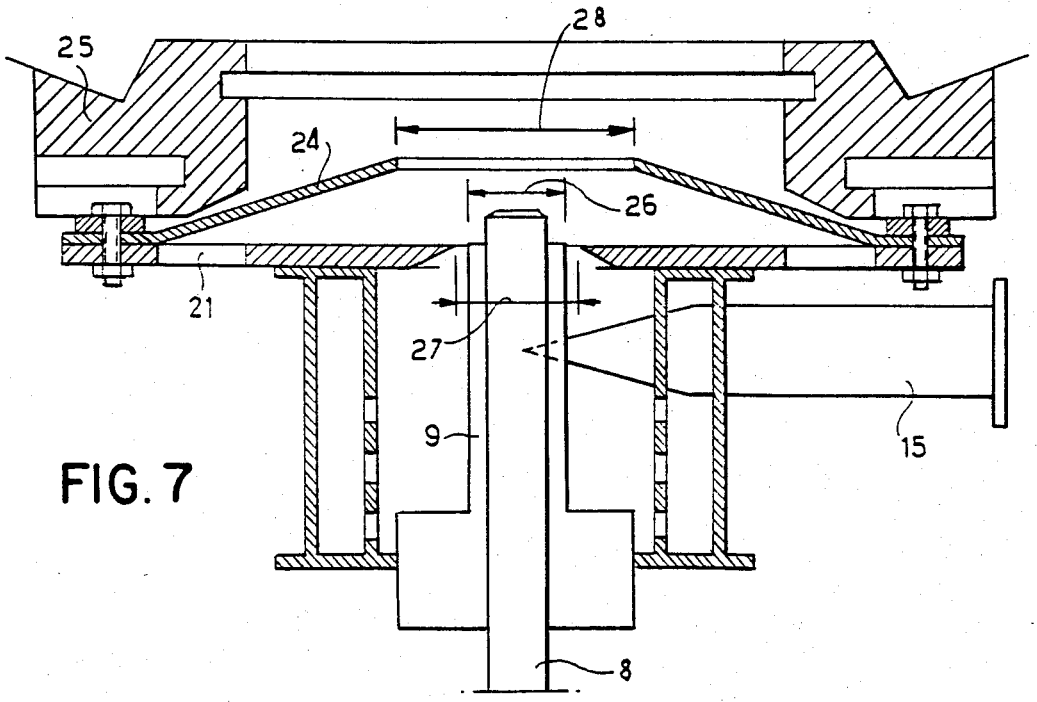

As stated previously, FIGS. 6 and 7 correspond to two embodiments of the device, according to the methods of assembly around the support plate, shown in detail in FIGS. 4 and 5 respectively.

The device according to the invention makes it possible to ensure the combustion of corrosive residues, in particular of chlorine-containing residues, under noteworthy conditions. In fact, complete combustion is observed which, in particular, avoids carbon deposits, whilst the temperature of the connecting plate/dispersing head/connection chamber does not exceed 50°-60°.

The examples which follow, which are given purely by way of indication, illustrate the process according to the invention.

EXAMPLE 1

The complete installation is composed of:

a burner assembly (FIGS. 2, 3, 4 and 6); in this device: the ratio (27)/(26) (FIG. 6) is 1.18 and the ratio (28)/(27) (FIG. 7) is 4.10;

| | |
|---|---|
| a combustion chamber (FIG. 1); | |
| a wetting device; | |
| a set of 3 Venturi-type absorbers; | not shown in the figures |
| and | |
| a neutralisation tower. | |

The pressure reduction is created in the combustion chamber by virtue of three Venturi devices in series.

This installation is used for the combustion of residues containing 15% by weight of polychlorobiphenyl (PCB) residues consisting of a mixture of 60% (by weight) of hexachlorobiphenyl and 40% of trichlorobenzene (empirical formula $C_2H_{0.8}Cl$).

These residues are introduced into the burner, through the central tube (12) of the injector, at a flow-rate of 800 kg/hour. The temperature of the combustion chamber is kept at 1,200° C. The pressure reduction in this same chamber is of the order of 1,000 Pa. Through the annular space (27)/(26), atomisation is effected by means of a hollow-vortex flow using primary air (tangential inlet 15) flowing at a rate of 1,500N $m^3$/hour, under $0.5.10^5$ Pa.

The pressure reduction created in the combustion chamber by virtue of the set of 3 Venturi devices in series permits the introduction of the secondary air required for the combustion. This air is divided into two flows:

A first flow at a rate of 1,500N $m^3$/hour, sucked through the openings (21) in the bottom plate (19) and guided to the base of the combustion by the deflecting cone (24). This air cools the interior of the deflecting cone (24).

A second flow at a rate of 1,500N $m^3$/hour sucked through the annular escape space (23) to complement the combustion. This air also cools the burner assembly and the exterior of the deflecting cone (24).

A light yellow/orange-coloured, stable incandescent medium forms at a temperature of 1,200° C. By recycling, into the combustion chamber, 1 t/hour of hydrochloric acid solution containing 30% of HCl, the fumes have the following composition (percentages by weight):

| | |
|---|---|
| $O_2$ | 3.5% |
| $N_2$ | 57.1% |
| $CO_2$ | 19.4% |
| $Cl_2$ | 0.004% |
| HCl | 8% |
| $H_2O$ | 12.0% |

A perfectly clear hydrochloric acid solution containing 30% of HCl is obtained from these fumes, the fumes discharged into the atmosphere not containing any detectable trace of carbon or of free chlorine. The analyses carried out both on the HCl solution and in the gaseous effluents show that the proportion of PCB is less than 1 ppm per tonne of residues incinerated; polychlorodibenzofuran and polychlorodibenzodioxin (detection limit: $10^{-8}$ g/ml) are not detected either.

EXAMPLE 2

In an installation which is similar in every respect to that of the previous example, except for the following ratios:

(27)/(26)=1.22 and (28)/(27)=4, it is proposed to destroy a liquid effluent originating from a carbon tetrachloride/perchloroethylene plant and having the following overall empirical formula: $C_2H_{0.127}Cl_{2.294}$.

The composition of this effluent is (percentages by weight):

| | |
|---|---|
| hexachlorobutadiene | 50% |
| hexachlorobenzene | 31.8% |
| tetrachlorobenzene | 10% |
| pentachlorobenzene | 7.2% |
| hexachloroethane | 1% |

This residue is a very viscous liquid having a crystallisation point above 160° C.

This residue, the flow-rate of which is 100 kg/hour, is introduced into the burner through the central tube (12), whilst 10 kg/hour of heavy fuel are fed in through the concentric tube (11) so as to supply sufficient heat and to keep the temperature of the combustion chamber at 1,200° C. The pressure reduction in this chamber is kept at about 1,000 Pa.

250N $m^3$/hour of atomising air are introduced, under $0.5.10^5$ Pa, through the annular space (27)/(26).

10N $m^3$/hour of tertiary air are injected through the annular space (14) between the tubes (10) and (11).

A first flow of secondary air, sucked through the holes (21) in the bottom of plate (19), has a flow-rate of 160N $m^3$/hour.

A second flow of secondary air, sucked through the annular escape space (23), has a flow-rate of 100N $m^3$/hour.

Taking account of some internal recycles to the unit—as in Example 1—the composition of the fumes leaving the combustion chamber is as follows (percentages by weight):

| | |
|---|---|
| $O_2$ | 3.7% |
| $N_2$ | 57.0% |
| $CO_2$ | 20.3% |
| $Cl_2$ | 0.4% |
| HCl | 14.5% |
| $H_2O$ | 4.2% |

After treatment of these fumes as in the previous example, a clear hydrochloric acid solution containing 30% by weight of HCl is obtained.

We claim:

1. Device for the combustion of products or mixtures of products which are corrosive or capable of generating corrosive products, by bringing the said products, in dispersed form, into contact with a combustive fluid at a temperature permitting the incandescence of the cloud of particles formed, the said device comprising a combustion chamber, a head for dispersing the product to be burnt in the said chamber, and a plate connecting the said dispersing head to the combustion chamber, said dispersing head comprising (A) means for the axial introduction of the product to be burnt into said combustion chamber, and means for introducing a first fraction of the combustive product into the combustion chamber in the form of a hollow-vortex flow, means for imparting a sufficient quantity of motion to cause the dispersion of the products to be burnt, by transfer of the quantity of motion, and (B) means for introducing at least one second fraction of the combustive product into the combustion chamber, and means for deflecting the said secondary fraction towards the base of the combustion zone, the dimensions and arrangement of the means B being such as to enable the second combustive fractions to form the complement of the combustive product required for the combustion and to ensure both the stabilization of the incandescent cloud and the cooling of the deflecting means and the connective plate, the head for dispersing the product to be burnt including (a) a chamber for causing the rotation of the first fraction of the combustive product having an outer envelope and an inner envelope defining an annular space therebetween and including perforations in an upstream portion of the inner envelope and tangential inlet means for introducing the combustive product into the annular space, (b) feeding means for introducing the fluid containing the products to be burnt, the dimensions and arrangement of an outlet zone of the chamber (a), and of the feeding means being such as to form a restricted annular passage and (c) the means for deflecting the second fraction toward the base of the combustion zone.

2. A device as claimed in claim 1 in which the ratio of the external diameter to the internal diameter of the restricted annular passage is within the range of 1.1 and 1.6.

3. A device as claimed in claim 1 in which the ratio of the external diameter to the internal diameter of the restricted annular passage is within the range of 1.15 and 1.4.

* * * * *